US005934139A

United States Patent [19]

Tucker

[11] Patent Number: 5,934,139

[45] Date of Patent: Aug. 10, 1999

[54] BI-DIRECTIONAL IMPACT TOOL

[76] Inventor: Kevin N. Tucker, 1755 Bonita Dr., Pueblo West, Colo. 81007

[21] Appl. No.: 09/071,208

[22] Filed: May 1, 1998

[51] Int. Cl.[6] ..... B21J 13/02

[52] U.S. Cl. ..... 72/479; 72/481.3; 72/705; 173/90

[58] Field of Search ..... 72/457, 479, 481.1, 72/481.3, 705; 173/90, 91

[56] References Cited

U.S. PATENT DOCUMENTS

| | | | |
|---|---|---|---|
| 3,313,356 | 4/1967 | Clevenger | 173/91 |
| 4,101,088 | 7/1978 | Stauth | 173/91 |
| 4,624,323 | 11/1986 | Burrola | 72/457 |
| 4,703,549 | 11/1987 | Grandt | 173/91 |
| 5,461,900 | 10/1995 | Guiterrez | 72/705 |
| 5,495,878 | 3/1996 | McKenen, Jr. | 173/90 |
| 5,526,722 | 6/1996 | Limehouse | 173/90 |
| 5,605,271 | 2/1997 | Russell | 173/90 |

*Primary Examiner*—Joseph J. Hail, III

*Assistant Examiner*—Ed Tolan

*Attorney, Agent, or Firm*—Timothy J. Martin; Michael R. Henson; Mark H. Weygandt

[57] ABSTRACT

A bi-directional impact tool includes a hollow tube member and a shaft slidably received by the hollow tube member in a telescopic relationship. The hollow tube member extends along a longitudinal axis and has a first end and a second end disposed opposite the first end. The shaft extends longitudinally along the longitudinal axis and has a working end disposed exteriorly of the hollow tube member for engaging the workpiece and a striking end disposed opposite the working end and interiorly of the hollow tube member. Moving the hollow tube member in a first direction so that the first end collides with the striking end while the working end is engaged with the workpiece imparts a first impact force to the workpiece in the first direction. Moving the hollow tube member in a second direction opposite the first direction so that the second end collides with the striking end while the working end is engaged with the workpiece imparts a second impact force to the workpiece in the second direction.

14 Claims, 6 Drawing Sheets

BI-DIRECTIONAL IMPACT TOOL

FIELD OF THE INVENTION

The present invention relates to a hand-operated tool. More particularly, the present invention is directed to an impact tool capable of driving a workpiece in a selected one of two opposing directions.

BACKGROUND OF THE INVENTION

Many different types of impact tools are known in the art. In U.S. Pat. No. 4,675,968 to Bartlett, a slide hammer-type puller and installer assembly is described. The slide hammer-type puller and installer assembly includes a shaft with an enlarged abutment disposed at one end and an enlarged adapter disposed at the other end. A weighted impact member which is also used as a hand grip is slidably mounted on the shaft between the abutment and the adapter. The weighted impact member slides along the shaft for selective impact with either the abutment or the adapter. Both the abutment and the adapter are threadedly engaged with the shaft.

U.S. Pat. No. 2,934,984 to Woodman discloses a dent removing hand tool for sheet metal. The dent removing hand tool includes a shaft and a weighted, cylindrical sleeve. The shaft has a first stop block at one end, a handle at an opposite end and a second stop block disposed between the first stop block and the handle. The sleeve slides along the shaft between the first and second stop blocks and selectively impacts either one of the stop blocks. A dent puller adapter is threadedly connected to the first stop block for engagement with the sheet metal.

Another hand tool for removing dents from metal is taught in U.S. Pat. No. 2,941,429 to Mason. This hand tool includes a shaft with a pair of stop members disposed apart from one another and a weighted sleeve slidable along the shaft between the stop members. The sleeve also acts as a hand grip. Each of two different puller adapters are connected to the shaft adjacent respective stop members. As previously described, the sleeve slides along the shaft for impacting a selected one of the stop members.

In U.S. Pat. No. 4,235,090 to Wightman et al, a dent pulling tool is disclosed. This dent pulling tool has a shaft with an interchangeable weighted head, a weight/hammer slidable along the shaft and a handle. The shaft has a handle stop member adjacent the handle and a distal stop member. The interchangeable weighted head pivots about an end of the shaft that is disposed opposite the handle. The interchangeable weighted head in an axially aligned position with the shaft is inserted through a hole formed in the dented material and is then pivoted to cause the interchangeable weighted head to move in a crosswise position relative to the shaft to form an anvil against the dented material.

U.S. Pat. No. 3,113,478 to Hall et al and U.S. Pat. No. 4,034,594 to Morgan also tech impact tools with a weighted sleeve slidable along a shaft for impacting a selected one of stop members disposed on the shaft.

However, each of the impact tools noted above has a drawback with regard to user safety. It is possible during use of these impact tools that one of the user's hands could slip off the tool while the sleeve is approaching impact with the selected stop member. If this occurs, a body part of the user such as a finger or portion of his/her hand could be crushed between the impacting sleeve and stop member. Thus, there is a need to provide an impact tool designed in such a manner that it would be impossible for the user to crush a finger or a portion of his/her hand while using the impact tool. The present invention satisfies this need.

SUMMARY OF THE INVENTION

It is an object of the present invention to provide a bi-directional impact tool that can impart an impact force to a workpiece in a selected one of two opposing directions.

Another object of the present invention is to provide a bi-directional impact tool that is safe to use and designed to particularly prevent a user from accidentally crushing a body part between colliding components.

Yet another object of the present invention is to provide a bi-directional impact tool having a plurality of interchangeable working tool elements so that a variety of functions can be performed depending upon the selected working tool element.

Another object of the present invention is to provide a bi-directional impact tool having interchangeable cap members with each having a different weighted mass.

A further object of the present invention is to provide a bi-directional impact tool having a removable handle assembly.

A still further object of the present invention is to provide a bi-directional impact tool that is simple to manufacture and easy to use.

Accordingly, a bi-directional impact tool of the present invention which is adapted for use to drive a workpiece is hereinafter described. In its broadest form, the bi-directional impact tool includes a hollow tube member and a shaft slidably received by the hollow tube member in a telescopic relationship. The hollow tube member extends along a longitudinal axis and has a first end and a second end disposed opposite the first end. The shaft extends longitudinally along the longitudinal axis and has a working end disposed exteriorly of the hollow tube member for engaging the workpiece and a striking end disposed opposite the working end and interiorly of the hollow tube member. The first end and the striking end are configured to engage one another when the hollow tube is moved in a first direction and in a second direction opposite the first direction. Moving the hollow tube member in the first direction so that the first end engages the striking end while the working end is engaged with the workpiece imparts a first impact force to the workpiece in the first direction. Correspondingly, moving the hollow tube member in the second direction while the working end is engaged with the workpiece imparts a second impact force to the workpiece in the second direction.

The structure which causes the first end and the striking end to engage one another preferably includes a shoulder portion extending radially inwardly from an inner wall of the hollow tube member so that it is disposed on the interior thereof. The shoulder portion has an opening sized and adapted to slidably receive the shaft. The striking end then includes a head portion sized and adapted to slide within the hollow tube member but larger than the opening so that the first impact force is imparted when the shoulder portion collides with the head portion. The second end of the hollow tube member is then enclosed so the second end will strike the striking end so that the second impact force is imparted in the second direction upon impact. A weighted cap member is preferably disposed on the distal end portion of the second end in a releasable manner so as to add additional mass for both the first and second impact forces. Here, the distal end portion is threaded and the cap member includes a longitudinally extended threaded hole sized to receive the threaded distal end portion. Thus, the cap member encloses the second end of the hollow tube member so that the cap member will collide with the striking end.

Structure may also be provided to prevent relative rotation between the shaft and the hollow tubular member. This structure preferably includes a longitudinally extending keyway and the first end of the hollow tube member includes a key element, such as a set screw, that extends radially inwardly into the keyway. This set screw threads through a bore extending radially in the first end.

The working end may be formed as a tool element selected from a group consisting of: a chisel, a hammer head, a fork, a wood chisel, a foot member, a hook, a claw, a dent puller and a clamp. Alternatively, the working end may include a longitudinally extending threaded stubshaft disposed axially thereon and adapted to releasably secure a tool element. Here, the tool element may again be selected from the above described group.

A handle may also be releasably connected to the shaft adjacent the working end. Preferably, the handle extends radially from the shaft and is secured thereto by a C-shaped clamp.

These and other objects of the present invention will become more readily appreciated and understood from a consideration of the following detailed description of the exemplary embodiment when taken together with the accompanying drawings, in which:

BRIEF DESCRIPTION OF THE DRAWINGS

FIG. 2(*b*) is a cross-sectional view of the bi-directional impact tool of the present invention shown in FIG. 2(*a*) driving the workpiece with a first impact force directed in the first direction;

FIG. 3(*b*)is a cross-sectional view of the bi-directional impact tool of the present invention shown in FIG. 3(*a*) driving another workpiece with a second impact force directed in the second direction;

DETAILED DESCRIPTION OF THE EXEMPLARY EMBODIMENTS

Figure 1:
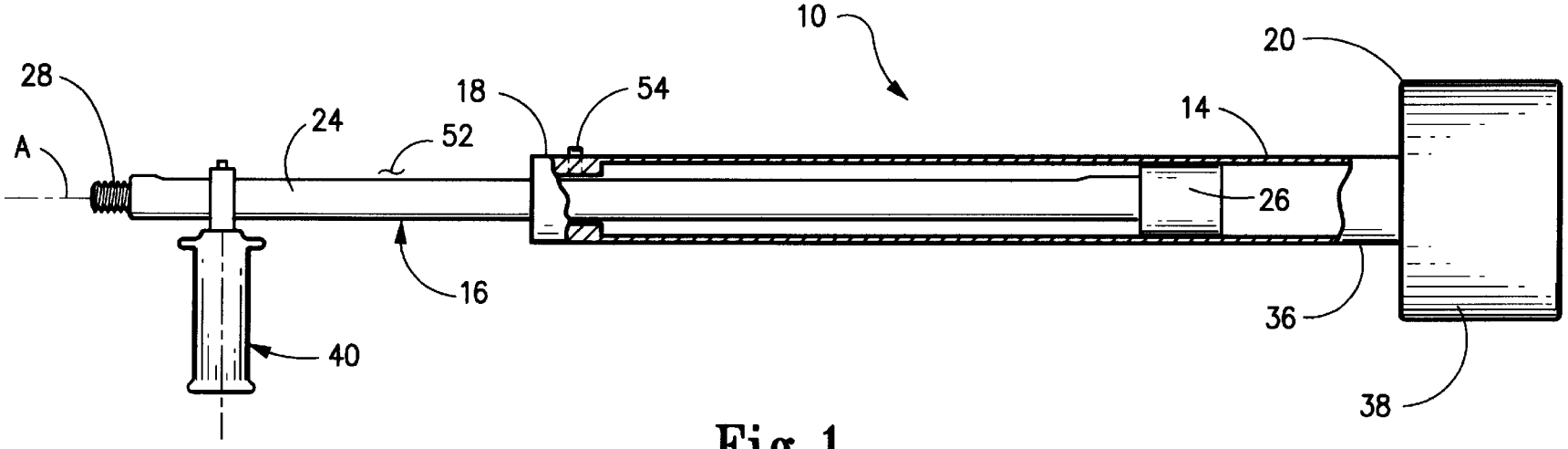
FIG. 1 is a partially broken-away perspective view of a bi-directional impact tool of the present invention.

A bi-directional impact tool 10 of the present invention is generally introduced in FIGS. 1–5 which is adapted for use to drive a workpiece 12 as discussed in detail below. The bi-directional tool 10 of the present invention includes a hollow tube member 14 and a shaft assembly 16. The hollow tube member 14 extends along a longitudinal axis "A" and has a first end 18 and a second end 20 that is disposed opposite the first end 18. The first end 18 is an opened end, i.e., the first end 18 has an opening 22 formed longitudinally through the first end 18 as best shown in FIGS. 2(*a*)–3(*b*). The opening 22 is disposed concentrically about the longitudinal axis "A". The second end 20 is a closed end which is discussed further below.

The shaft assembly 16 includes a shaft 24 that extends longitudinally along the longitudinal axis "A". The shaft 24 is slidably received by the hollow tube member 14 through the opening 22 in a telescopic relationship with a hollow tube member 14. The shaft 24 has a working end 28 disposed exteriorly of the hollow tube member 14 and is adapted for engaging the workpiece 12. The shaft 24 also has a striking end in a form of a head portion 26 which is disposed opposite the working end 28 and interiorly of the hollow tube member 14. The head portion 26 is connected to the shaft 24 and is sized larger than the opening 22.

Operation of the bi-directional impact tool 10 of the present invention is illustrated in FIGS. 2(*a*)–3(*b*). In FIGS. 2(*a*)–2(*b*), the bi-directional impact tool 10 of the present invention is used in a first direction "F" to drive the workpiece 12 in the first direction. By way of example only in FIGS. 2(*a*)–2(*b*), the workpiece 12 is dented sheet metal and the bi-directional impact tool 10 of the present invention is used as a dent puller to pull the dented sheet metal in the first direction "F" to pull out the dent. In FIGS. 3(*a*)–3(*b*), the bi-directional impact tool 10 of the present invention is used in a second direction "S" to drive the workpiece 12 in the second direction which is opposite to the first direction. By way of example only in FIGS. 3(*a*)–3(*b*), the workpiece 12 is a conventional nail being driven into a piece of wood in the second direction "S".

As shown in FIG. 2(*a*), while the working end 28 is engaged with the workpiece 12, the hollow tube member 14 is moved in the first direction "F". In FIG. 2(*b*), the first end 18 collides with the head portion 26 so that a first impact force "$I_1$" is imparted to the workpiece 12 in the first direction "F". As shown in FIG. 3(*a*), while the working end 28 is engaged with the workpiece 12, the hollow tube member 14 is moved in a second direction "S". In FIG. 3(*b*), the second end 20 collides with the head portion 26 so that a second impact force "$I_2$" is imparted to the workpiece 12 in the second direction "S". Thus, these example, one of ordinary skill in the art would comprehend that the bi-directional impact tool 10 of the present invention is useful for driving a workpiece in a selected one of two opposite directions.

As best shown in FIGS. 3(*a*)–3(*b*), the first end 18 of tube member 14 includes collar 30 that is connected to an inner wall 32 of the hollow tube member 14. The collar 30 defines the opening 22 and forms a shoulder portion 34 which is disposed interiorly of the hollow tube member 14 and extends radially inwardly from the inner wall 32. The head portion 26 is sized and adapted to slide within the hollow tube member 14 so that the first impact force "$I_1$" is imparted to the workpiece 12 when the shoulder portion 34 collides with the head portion 26 as illustrated in FIG. 2(*b*).

Figure 2A:
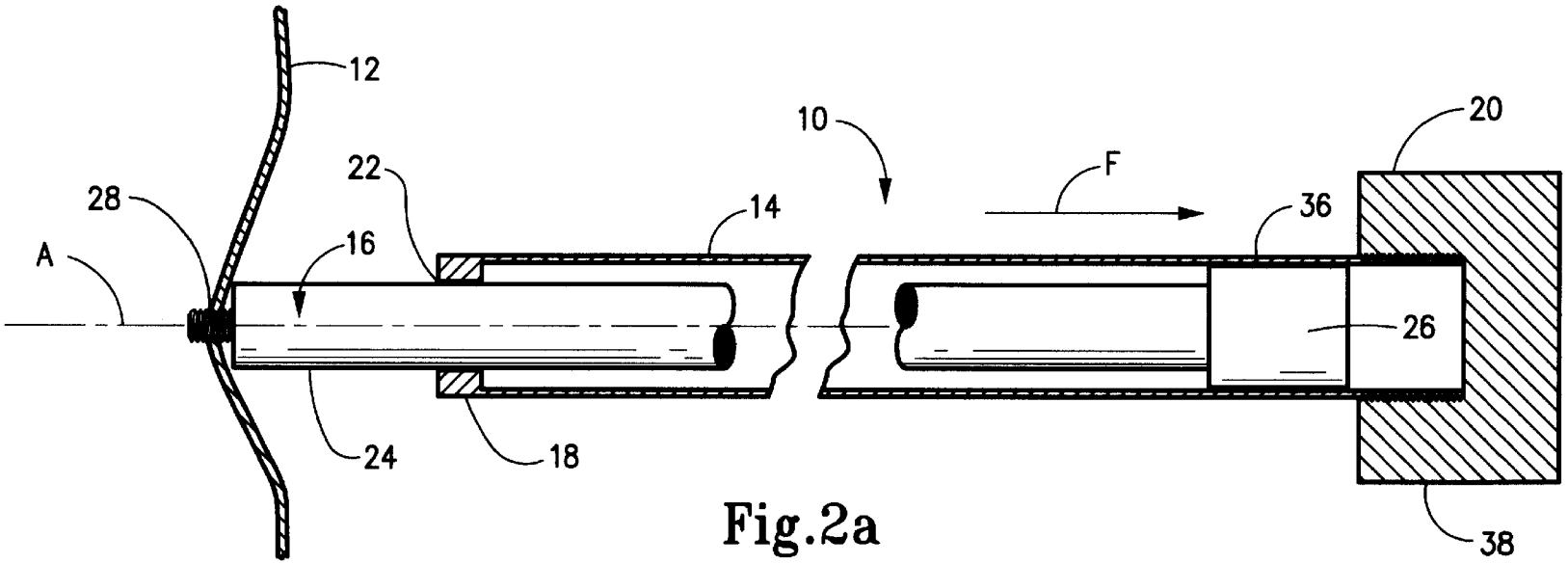
FIG. 2(*a*) is a cross-sectional view of the bi-directional impact tool of the present invention engaged with a workpiece and being moved in a first direction.
Figure 2B:
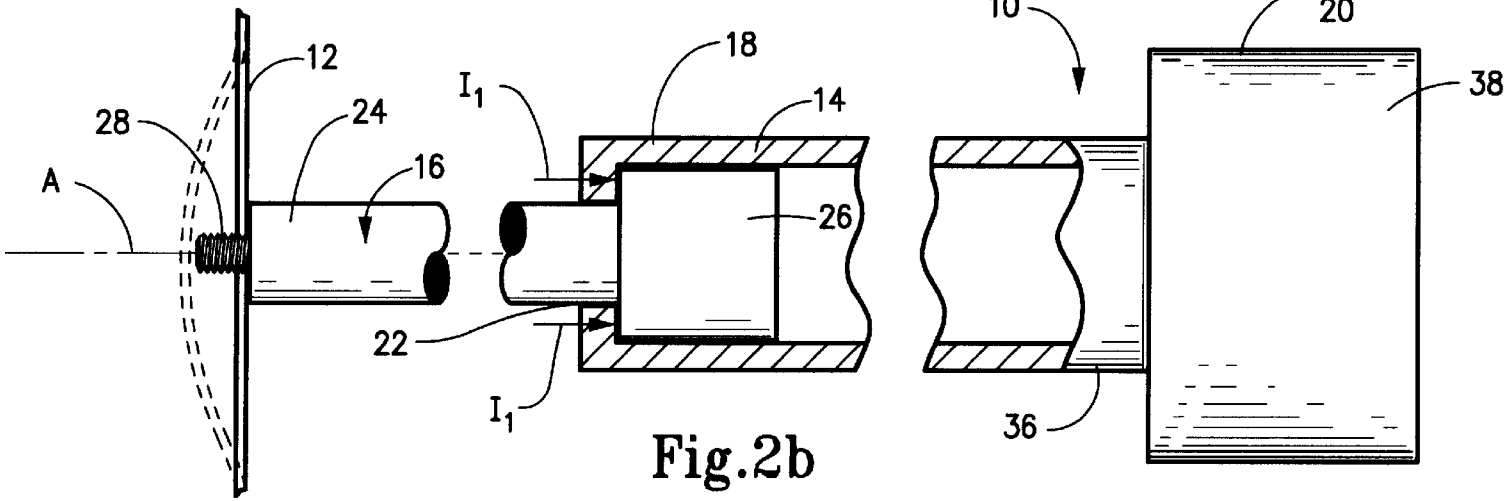
Figure 3A:
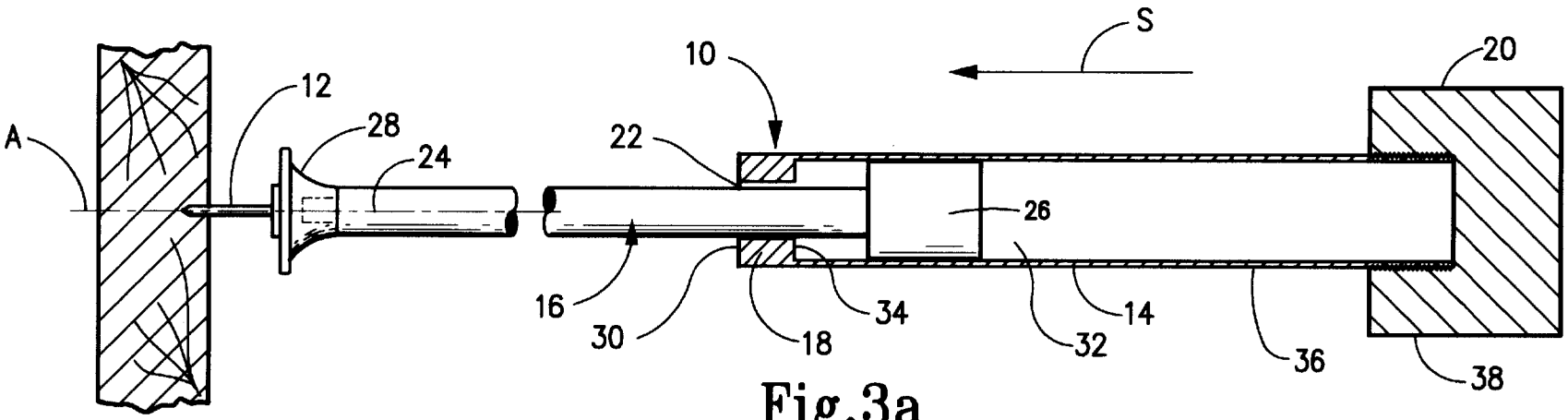
FIG. 3(*a*) is a cross-sectional view of the bi-directional impact tool of the present invention engaged with another workpiece and being moved in a second direction.
Figure 3B:
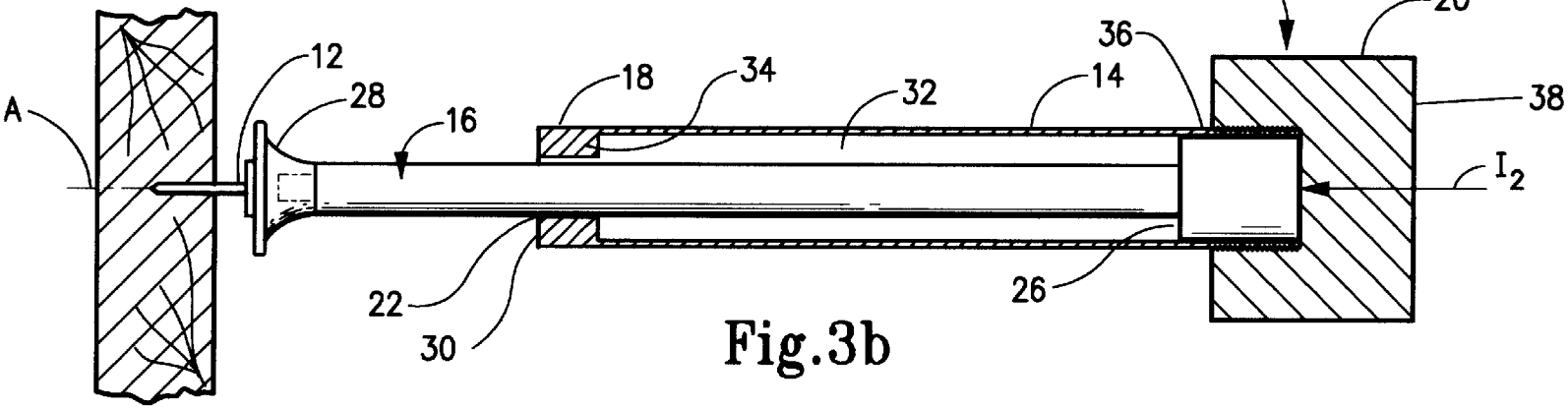

With reference to FIGS. 1–3(*b*), the second end 20 includes a distal end portion 36 and a weighted cap member 38 that is connected to the distal end portion 36. In FIG. 2(*a*), the distal end portion 36 and the cap member 38 are releasably connected to each other. Specifically, the distal end portion 36 is threaded and the cap member 38 includes a longitudinally-extending threaded hole sized to receive the threaded distal end portion 36 so that the distal end portion 36 and the cap member 38 matably engage with each other. With this arrangement, the shaft assembly 16 could be removed from the hollow tube member 14 when the cap member 38 and the distal end portion 36 are disengaged.

Also, as shown in FIG. 3(*b*), the second impact force "$I_2$" is imparted to the workpieces 12 when the cap member 38 collides with the head portion 26. The cap member 38 is a weighted mass, the size of which depends upon the type of operation the bi-directional impact tool 10 of the present invention is to be used. For example, if the dented sheet material in FIGS. 2(*a*)–2(*b*) is a thick gauge, a heavy weighted mass could be used and, if the piece of wood in FIGS. 3(*a*)–3(*b*) is soft, a light weighted mass could be used.

Figure 4:
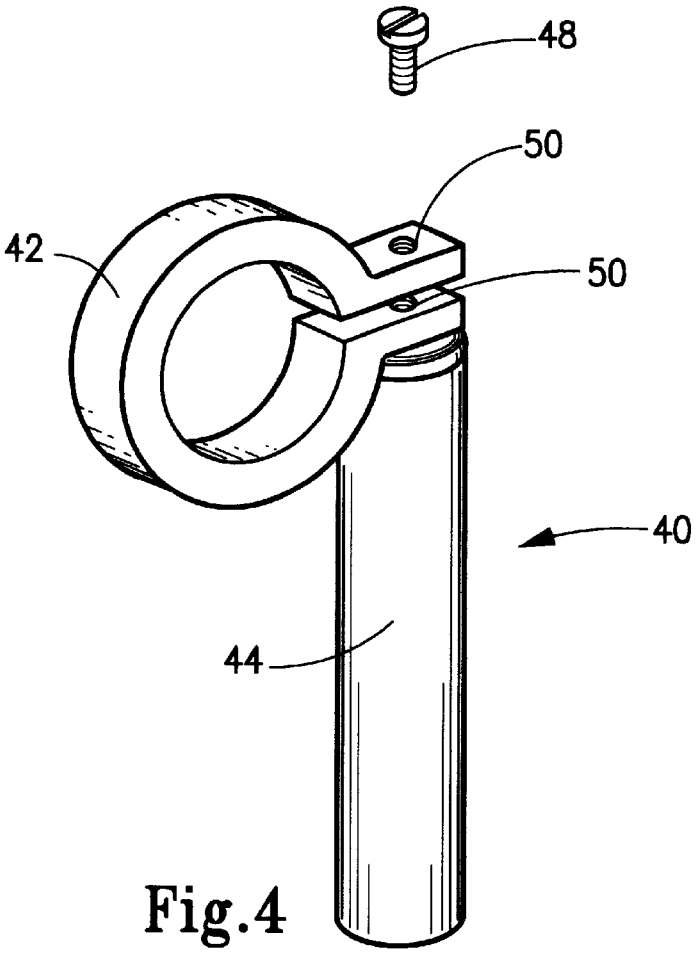
FIG. 4 is a perspective view of a removable handle assembly that can be used with a bi-directional impact tool of the present invention.

FIGS. 1 and 4, the bi-directional impact tool 10 includes a handle assembly 40. The handle assembly 40 is releasably connected to the shaft 24 adjacent the working end 28 of the shaft 24. In FIG. 1, it is preferred that the handle assembly 40 extends radially from the shaft 24. With reference to FIG. 4, the handle assembly 40 includes a C-shaped clamp 42 and a handle 44 connected to the C-shaped clamp 42 in a conventional manner. The handle assembly 40 is connected to the shaft 24 by a clamp set screw 48 that threadedly engages a threaded clamp bores 50. The handle assembly 40 is employed at the option of the user.

Figure 5:
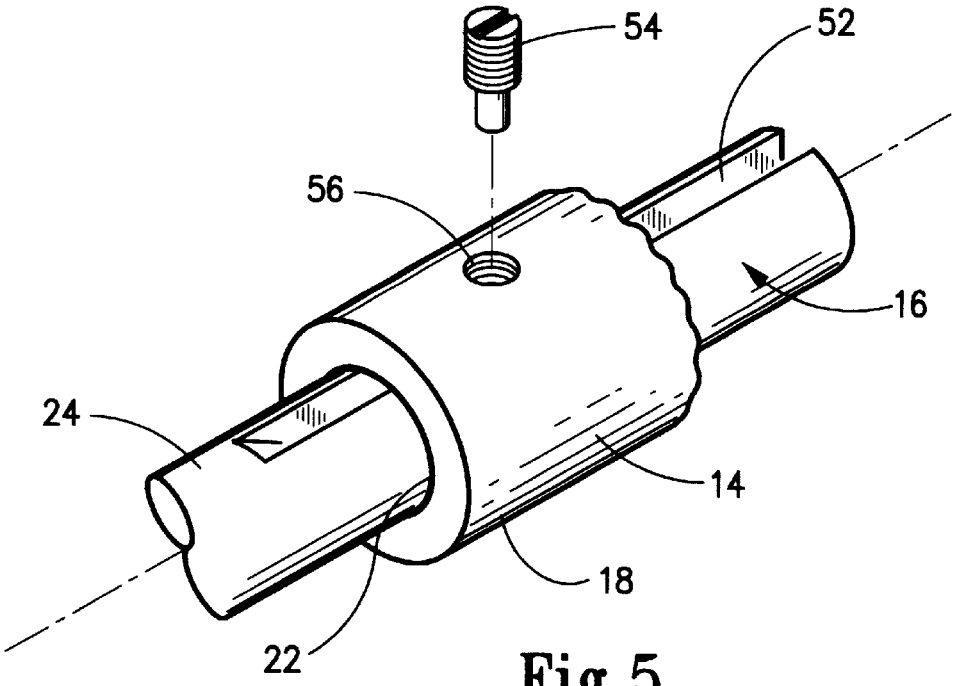
FIG. 5 is a partial perspective view of a shaft having a keyway and a hollow tube member with a first end and a key for the keyway.

As shown in FIGS. 1 and 5, it is preferred that the shaft 24 includes a longitudinally extending keyway 52 to prevent relative rotation of tube member 14 and shaft 24. Correspondingly, the first end 18 includes a key element 54 in a form of a first end set screw. The key element 54 threadedly engages a threaded first end bore 56 formed into the first end 18 and extends radially therethrough as best shown in FIG. 5. When threadedly engaged, the key element 54 extends radially inwardly toward the longitudinal axis "A" to projecting into the keyway 52 as shown in FIG. 1. When threadedly engaged, the key element 54 prevents the shaft 24 from rotating relative to the hollow tube member 14. Preventing such rotation by using the keyway 52 and key element 54 is at the option of the user.

Note in FIGS. 1–2(*b*) that the working end 28 is a longitudinally-extending threaded stubshaft that is disposed concentrically relative to the longitudinal axis (A). As particularly shown in FIGS. 2(*a*)–2(*b*), the threaded stubshaft is used as the working end 28 by directly connecting to the workpieces 12. However, it should be understood by a skilled artisan that the threaded stubshaft can be releasably connected to a selected one of a plurality of working end adapters, each of which is shown by way of example in FIGS. 6–13. Thus, the working end of the bi-directional tool 10 of the present invention can be used to perform a variety of operations depending upon the working end adapter selected.

Figure 6:
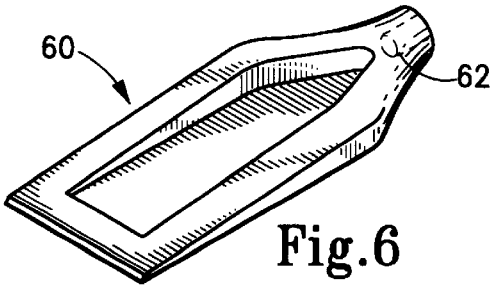
FIG. 6 is a perspective view of a removable chisel adapted as a working end of the bi-directional impact tool of the present invention.

FIG. 6 illustrated a working end adapter 60 in a form of a chisel. The working end adapter 60 includes an adapter end portion 62 that is sized and adapted for threaded engagement with the stubshaft.

Figure 7:
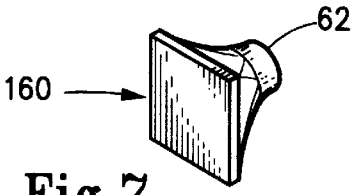
FIG. 7 is a perspective view of a removable hammer head adapted as a working end of the bi-directional impact tool of the present invention.

FIG. 7 illustrates another working end adapter 160 in a form of a hammer head. Like all working end adapters, the working end adapter 160 includes the adapter end portion 62. Operation of the hammer head working end adapter 160 is illustrated in FIGS. 3(*a*)–3(*b*).

Figure 8:
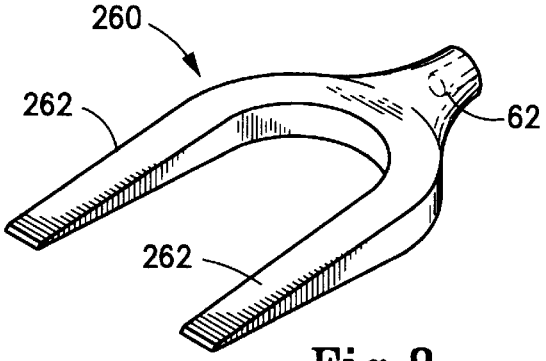
FIG. 8 is a perspective view of a removable fork adapted as a working end of the bi-directional impact tool of the present invention.

FIG. 8 illustrated yet another working end adapter 260 in a form of a fork. The fork is tapers from the adapter end portion 62 toward prongs 262. This type of fork is commonly known as a ball joint fork.

Figure 9:
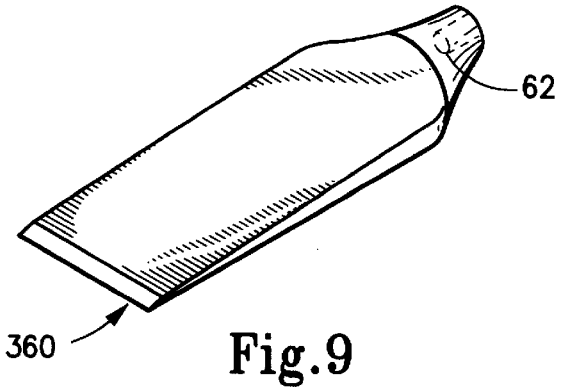
FIG. 9 is a perspective view of a removable wood chisel adapted as a working end of the bi-directional impact tool of the present invention.

FIG. 9 illustrates another working end adapter 360 in a form of a wood chisel.

Figure 10:
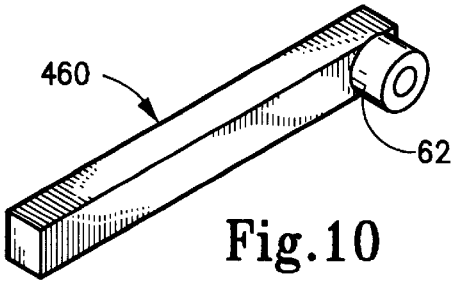
FIG. 10 is a perspective view of a removable foot member adapted as a working end of the bi-directional impact tool of the present invention.

FIG. 10 illustrated yet another working end adapter 460 in a form of a foot member.

Figure 11:
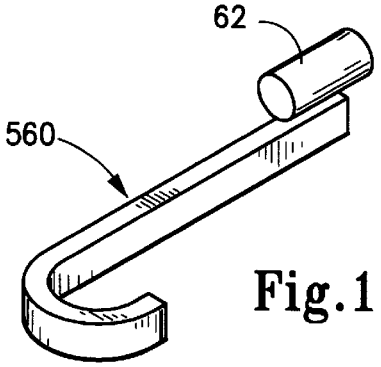
FIG. 11 is a perspective view of a removable hook adapted as a working end of the bi-directional impact tool of the present invention.

FIG. 11 illustrates another working end adapter 560 in a form of a hook.

Figure 12:
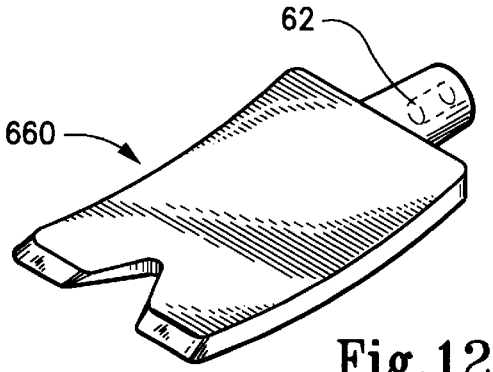
FIG. 12 is a perspective view of a removable claw adapted as a working end of the bi-directional impact tool of the present invention.

FIG. 12 illustrates another working end adapter 660 in a form of a claw. A skill artisan would appreciate that the bi-directional tool 10 of the present invention can also be used as a lever, as opposed to a hammer, when the claw working end adapter 660 is connected. Furthermore, When the claw working end adapter 660 is connected to the stubshaft and engaged with the workpiece, the hollow tube member can be slid into a desirable position relative to the shaft to gain a desired mechanical advantage.

Figure 13:
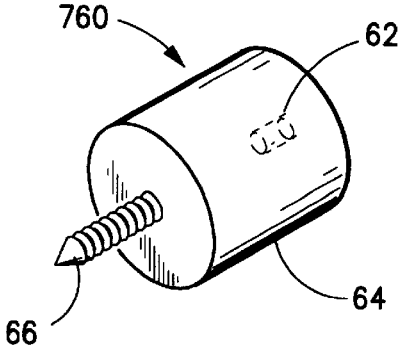
FIG. 13 is a perspective view of a removable dent puller adapted as a working end of the bi-directional impact tool of the present invention.

FIG. 13 illustrates another working end adapter 760 in a form of a dent puller. The dent puller working end adapter 760 includes a cylindrical body member 64 and a tapered threaded shaft 66.

Figure 14:
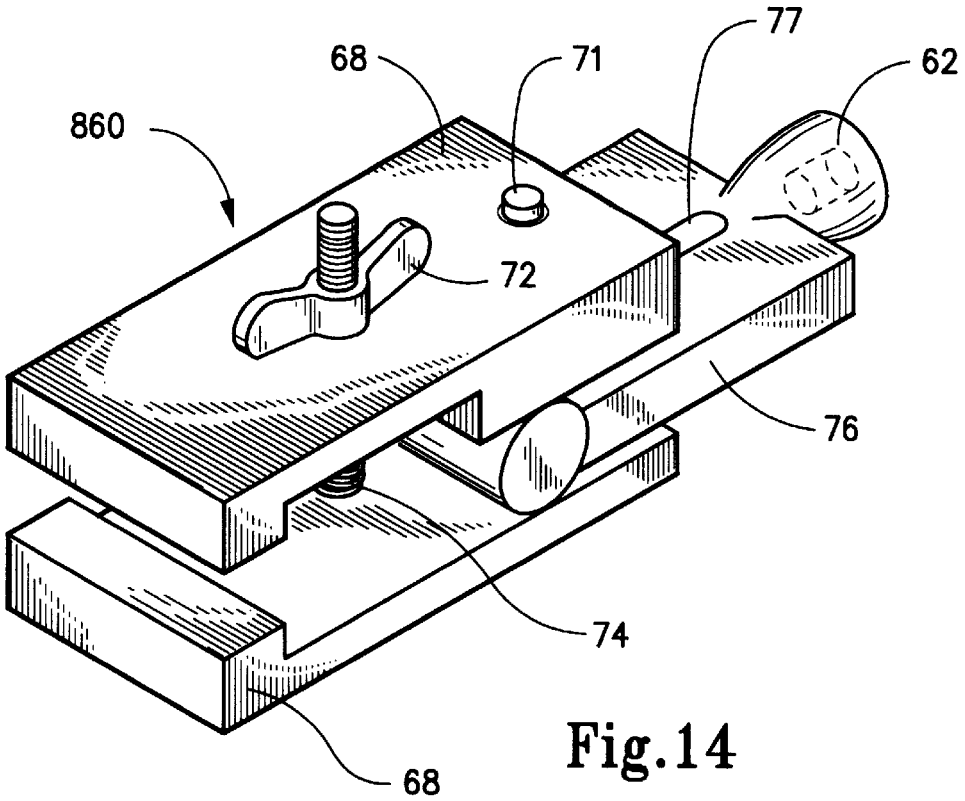
FIG. 14 is a perspective view of a removable clamp adapted as a working end of the bi-directional impact tool of the present invention.
Figure 15:
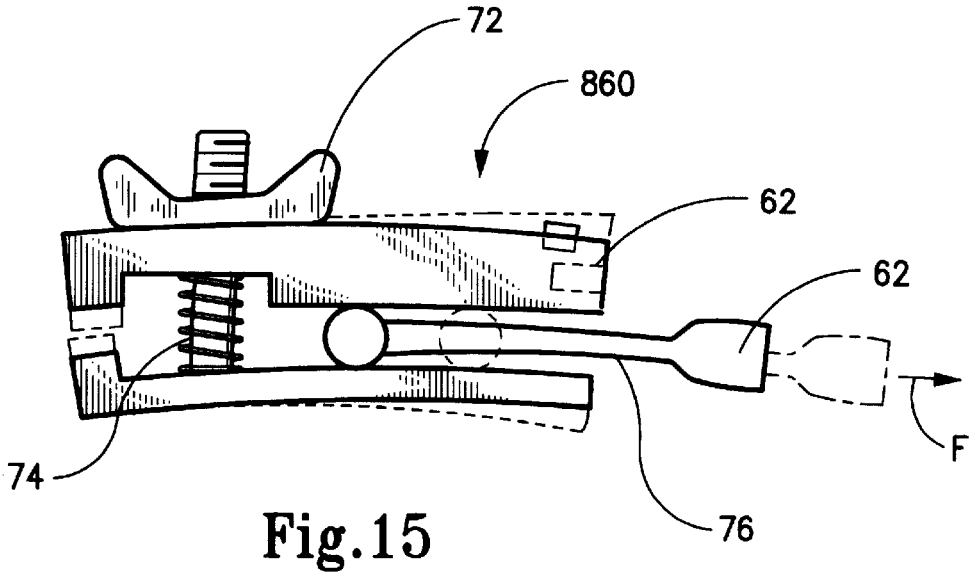
FIG. 15 is a side elevational view of the removable clamp illustrating closure of a pair of jaws when the first impact force is imparted.

FIGS. 14 and 15 illustrate another working end adapter 860 in a form of a clamp. The clamp working end adapter 860 includes a pair of jaws 68 pivotally connected to a screw shaft 70 matably engaged with a wing nut 72 and to a fulcrum pin 71. A spring element 74 biases the pair of jaws 68 away from each other. A wedge member 76 is disposed between the pair of jaws 68 at a front end portion and a rear end portion forms the adapter end portion 62. A slot 77 is centrally located thereon to receive pin 71. Clamp adapter 860 may be clamped onto a workpiece by tightening nut 72. When the first impact force is then imparted to the workpiece in the first direction "F", the pair of jaws move closer to each other as shown in FIG. 15 thereby tightening a clamping grip on the workpiece.

The bi-directional impact tool of the present invention imparts an impact force to a workpiece in a selected one of two opposing directions. Further, the bi-directional impact tool of the present invention is safe to use because its inherent design prevents the user from accidentally crushing a finger or other body part between the colliding components. Also, bi-directional impact tool has a plurality of interchangeable working tool adapters so that a variety of functions can be performed by the present invention depending upon the selected working tool adapter. Interchangeable cap members with each having a different weighted mass can be used depending upon the amount of impact desired by the user. A removable handle assembly can be used with the bi-directional tool of the present invention. The bi-directional impact tool is simple to assemble and disassemble and easy to manufacture and to use.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. A bi-directional impact tool adapted for use to drive a workpiece, comprising:

(a) a hollow tube member extending along a longitudinal axis having a first end and a second end disposed opposite the first end, wherein the second end includes a distal end portion and a weighted cap member releasably connected to the distal end portion; and (b) a longitudinally extending shaft slidably received by the hollow tube member in a telescopic relationship and having a working end disposed exteriorly of the hollow tube member for engaging the workpiece and a striking end disposed opposite the working end and interiorly of the hollow tube member, said striking end and said first end configured to engage one another when said hollow tube member is moved in a first direction and said striking end and said second end configured to engage one another when said hollow tube member is moved in a second direction opposite the first direction, whereby moving the hollow tube member in the first direction so that the first end engages with the striking end while the working end is engaged with the workpiece imparts a first impact force to the workpiece in the first direction, and moving the hollow tube member in the second direction so that the second end engages with the striking end while the working end is engaged with the workpiece imparts a second impact force to the workpiece in the second direction.

2. A bi-directional impact tool according to claim 1 wherein the first end includes a shoulder portion and a longitudinally extending opening sized and adapted to slidably receive the shaft, the shoulder portion disposed interiorly of the hollow tube member and extending radially inwardly from an inner wall of the hollow tube member and wherein the striking end includes a head portion sized and adapted to slide within the hollow tube member so that the first impact force is imparted when the shoulder portion collides with the head portion.

3. A bi-directional impact tool according to claim 1 wherein the distal end portion is threaded and the cap member includes a longitudinally extending threaded hole sized to receive the threaded distal end portion so that the distal end portion and the cap member matably engage with each other.

4. A bi-directional impact tool according to claim 1 wherein said cap member encloses the second end of said hollow tube member so that the second impact force is imparted when the cap member collides with the striking end.

5. A bi-directional impact tool according to claim 1 wherein the shaft includes a longitudinally extending keyway and the first end includes a key element extending radially inwardly and projecting into the keyway and operative to prevent relative rotation of said shaft and said hollow tube member.

6. A bi-directional impact tool according to claim 5 wherein the first end includes a threaded bore extending radially therethrough and the key element is a set screw sized for matable engagement with the threaded bore.

7. A bi-directional impact tool according to claim 1 wherein the working end includes a longitudinally extending threaded stubshaft disposed axially thereon and adapted to releasably secure a tool element.

8. A bi-directional impact tool according to claim 1 wherein said tool element is selected from a group consisting of a chisel, a hammer head, a fork, a wood chisel, a foot member, a hook, a claw, a dent puller and a clamp.

9. A bi-directional impact tool according to claim 8 wherein the working end includes a longitudinally extending threaded stubshaft disposed concentrically relative to the longitudinal axis.

10. A bi-directional impact tool according to claim 9 wherein each one of a chisel, a hammer head, a fork, a wood chisel, a foot member, a hook, a claw, a dent puller and a clamp is sized and adapted for releasable connection to the stubshaft.

11. A bi-directional impact tool adapted for use to drive a workpiece, comprising:

(a) a hollow tube member extending along a longitudinal axis having an opened end with an opening formed longitudinally therethrough and concentrically about the longitudinal axis and a closed end disposed opposite the opened end; and (b) a longitudinally extending shaft assembly including a shaft and a head portion, the shaft being slidably received by the hollow tube member through the opening in a telescopic relationship and having a working end disposed exteriorly of the hollow tube member for engaging the workpiece, the head portion connected to the shaft opposite the working end and disposed interiorly of the hollow tube member and sized larger than the opening, said shaft including a longitudinally extending keyway and the opened end including a key element extending radially inwardly and projecting into the keyway and operative to prevent relative rotation of the shaft and the hollow tube member, whereby moving the hollow tube member in a first direction so that the opened end collides with the head portion while the working end is engaged with the workpiece, a first impact force is imparted to the workpiece in the first direction and moving the hollow tube member in a second direction opposite the first direction so that the closed end collides with the head portion while the working end is engaged with the workpiece, a second impact force is imparted to the workpiece in the second direction.

12. A bi-directional impact tool according to claim 11, wherein the closed end has a weighted cap member releasably connected to the hollow tube member.

13. A bi-directional impact tool adapted for use to drive a workpiece, comprising:

(a) a hollow tube member extending along a longitudinal axis having a first end and a second end disposed opposite the first end; and (b) a longitudinally extending shaft slidably received by the hollow tube member in a telescopic relationship and having a working end disposed exteriorly of the hollow tube member for engaging the workpiece and a striking end disposed opposite the working end and interiorly of the hollow tube member, said striking end and said first end configured to engage one another when said hollow tube member is moved in a first direction and said striking end and said second end configured to engage one another when said hollow tube member is moved in a second direction opposite the first direction, whereby moving the hollow tube member in the first direction so that the first end engages with the striking end while the working end is engaged with the workpiece imparts a first impact force to the workpiece in the first direction, and moving the hollow tube member in the second direction so that the second end engages with the striking end while the working end is engaged with the workpiece imparts a second impact force to the workpiece in the second direction;

(c) a handle assembly releasably connected to the shaft adjacent the working end and extending radially therefrom, wherein said handle assembly is angularly rotatable around the shaft whereby said handle assembly is securable at a selected angular location relative to the shaft.

14. A bi-directional impact tool according to claim 13 wherein the handle assembly includes a C-shaped clamp and a handle connected to the C-shaped clamp.

* * * * *